US006761933B2

(12) United States Patent
Warburton et al.

(10) Patent No.: US 6,761,933 B2
(45) Date of Patent: Jul. 13, 2004

(54) PROCESS FOR COATING UNTREATED METAL SUBSTRATES

(75) Inventors: Yi J. Warburton, Moon Township, PA (US); Michel Sudour, Sebourg (FR); Andreas Tolz, Haguenau (FR)

(73) Assignee: PPG Industries Ohio, Inc., Cleveland, OH (US)

( * ) Notice: Subject to any disclaimer, the term of this patent is extended or adjusted under 35 U.S.C. 154(b) by 85 days.

(21) Appl. No.: 10/279,688

(22) Filed: Oct. 24, 2002

(65) Prior Publication Data

US 2004/0079647 A1 Apr. 29, 2004

(51) Int. Cl.[7] ..... B05D 1/36; B05D 7/16
(52) U.S. Cl. ..... 427/410
(58) Field of Search ..... 427/409, 410

(56) References Cited

U.S. PATENT DOCUMENTS

| | | | | |
|---|---|---|---|---|
| 5,139,586 A | 8/1992 | Das | ..... | 148/246 |
| 5,209,788 A | 5/1993 | McMillen et al. | ..... | 148/247 |
| 5,952,049 A | 9/1999 | Tomlinson | ..... | 427/327 |
| 5,964,928 A | 10/1999 | Tomlinson | ..... | 106/14.21 |
| 6,027,579 A | 2/2000 | Das et al. | ..... | 148/256 |
| 6,217,674 B1 | 4/2001 | Gray et al. | ..... | 148/247 |

FOREIGN PATENT DOCUMENTS

| | | | |
|---|---|---|---|
| JP | 52-070949 | * | 6/1977 |
| WO | WO96/19595 | | 6/1996 |
| WO | WO 2001/46495 | * | 6/2001 |

* cited by examiner

*Primary Examiner*—Erma Cameron
(74) *Attorney, Agent, or Firm*—Diane R. Meyers

(57) ABSTRACT

An improved process for applying a coating to an untreated ferrous metal substrate is disclosed. The substrate does not need to be phosphated or subjected to any other conversion coating prior to treatment. The process includes contacting the substrate surface first with a solution comprising a Group IIIB and/or IVB metal-containing compound and a nitrate, and then with a second solution comprising a reaction product of an epoxy and an amine, phosphorus or sulfur-containing compound. A film-forming resin is then deposited on the substrate and cured. Substrates treated by the process of the present invention demonstrate excellent corrosion resistance and are also disclosed herein.

12 Claims, No Drawings

PROCESS FOR COATING UNTREATED METAL SUBSTRATES

FIELD OF THE INVENTION

This invention relates generally to corrosion-resistant coated metal substrates and, more particularly, to ferrous and non-ferrous metal substrates having an environmentally friendly chrome-free and nickel-free pretreatment that inhibits corrosion of the metal substrate.

BACKGROUND OF THE INVENTION

Pretreating metal substrates with a phosphate conversion coating and rinsing with a chrome-containing sealer are well known for promoting corrosion resistance and improving the adhesion of subsequently applied decorative and protective coatings. Cationic electrodeposition compositions are typically applied over phosphated steel substrates to further improve corrosion resistance. While the combination of phosphate conversion coating and electrodeposited coating provides superior corrosion resistance, heavy metals typically used in such coatings can provide environmental disposal concerns. For example, phosphate conversion coating compositions typically contain heavy metals such as nickel, and post-rinses contain chrome. Also, conventional phosphating processes can require several stages that occupy a large amount of physical space in a plant and require significant capital investment. Another drawback of conventional phosphating processes is the difficulty in coating mixed-metal objects including aluminum. In addition, many pretreatment and post-rinse compositions are suitable for use over only a limited number of substrates or over substrates that must be phosphated first, or are not suitable for use without some other treatment.

It would be desirable to provide a simplified pretreatment process free of heavy metals for coating metal substrates, including mixed metal substrates such as those commonly found on today's automobile bodies. Such a pretreatment process, when combined with heavy-metal free coatings, would provide an environmentally friendly alternative for providing corrosion resistance to metal substrates.

SUMMARY OF THE INVENTION

The present invention is directed to a method for coating an untreated metal substrate by contacting the substrate sequentially with two different pretreatment solutions. The first pretreatment solution comprises a Group IIIB and/or IVB metal-containing compound and nitrate. The second pretreatment solution comprises a reaction product of at least one epoxy-functional material or derivative thereof and at least one material selected from the group consisting of phosphorus-containing materials, amine-containing materials, sulfur-containing materials and mixtures thereof. Following the two steps, the substrate is coated with a composition comprising a film-forming resin. The resin can then be cured by any means appropriate for curing the resin.

It is significant that the present methods are directed to untreated metal substrates. As used herein, the term "untreated" means a bare metal surface; that is, the metal surface has not been phosphated or subjected to any other type of conversion coating. Following contact with the two pretreatment solutions, the substrate is then rinsed and/or directly coated with, for example, a pigmented coating comprising a film-forming resin. The coated substrates that result exhibit excellent corrosion resistance. It is significant that this corrosion resistance is achieved with the use of chrome-free and heavy metal-free pretreatment solutions. Thus, an environmentally friendly method is provided, wherein corrosion resistance is not sacrificed.

DETAILED DESCRIPTION OF THE INVENTION

The present invention is directed to a method for coating an untreated metal substrate comprising contacting the substrate with a first pretreatment solution comprising a Group IIIB and/or IVB metal-containing compound and nitrate; subsequently contacting the substrate with a second pretreatment solution comprising a reaction product of at least one epoxy-functional material or derivative thereof and at least one material selected from the group consisting of phosphorus-containing materials, amine-containing materials, sulfur-containing materials and mixtures thereof; and coating the substrate with a composition comprising a film-forming resin.

Both ferrous and non-ferrous metal substrates can be treated according to the present invention. Examples of ferrous metals include cold rolled steel substrates, galvanized steel substrates, including electrogalvanized steel, hot dipped galvanized steel, galvanneal (an Fe/Zn alloy), and stainless steel. Nonferrous metals including, for example, aluminum, magnesium, and copper. It will be appreciated that many substrates that are suitable for treatment according to the present invention will include both ferrous and non-ferrous metals (i.e. "mixed metals"). For example, many automobile assemblies contain both galvanized steel and aluminum. It is an advantage of the present invention that the same composition can be used to treat all of these substrates, with suitable corrosion protection being offered to each. In addition, the untreated metal substrate suitable for use in the present methods may be a cut edge of a substrate that is otherwise treated and/or coated over the rest of its surface.

The substrate to be coated is usually first cleaned to remove grease, dirt, or other extraneous matter. This is done with conventional cleaning procedures and materials, including mild or strong alkaline cleaners that are commercially available and conventionally used in metal pretreatment processes. Examples of alkaline cleaners include CHEMKLEEN 611L, CHEMKLEEN 163 and CHEMKLEEN 177, all of which are available from PPG Industries, Inc. Such cleaners are generally followed and/or preceded by a water rinse.

Following the optional cleaning step, the metal surface is contacted with the first pretreatment solution. As noted above, this solution comprises a Group IIIB and/or IVB metal. The Group IIIB and IVB metals referred to herein are those elements referred to as transition metals and rare earth metals and which are included in such groups in the CAS Periodic Table of the Elements as is shown, for example, in the *Handbook of Chemistry and Physics*, 63rd Edition (1983). It will be appreciated that Group IIIB includes the lanthanides and actinides. Especially suitable Group IIIB and IVB transition metals and rare earth metals are those that contain zirconium, titanium, hafnium, yttrium and cerium and mixtures thereof. The Group IIIB and/or IVB metals can be introduced in various forms, including as nitrates, acetates, sulfamates, lactates, glycolates, formates and dimethylol propionates, where such compounds exist. Typical zirconium compounds may be selected from hexafluorozirconic acid and alkali metal and ammonium salts thereof, ammonium zirconium carbonate, zirconium sulfate, zirconyl nitrate, zirconium carboxylates and zirconium hydroxy carboxylates such as hydrofluorozirconic acid, zirconium acetate, zirconium oxalate, ammonium zirconium glycolate, ammonium zirconium lactate, ammonium zirconium citrate, and mixtures thereof. Hexafluorozirconic acid is especially suitable. An example of a titanium compound is fluorotitanic acid and its salts. An example of a hafnium compound is hafnium nitrate. An example of a yttrium compound is yttrium nitrate. An example of a cerium compound is cerous nitrate.

The first pretreatment solution also comprises nitrate. The nitrate can be introduced in any form; sodium nitrate is especially suitable. It will be appreciated that nitrate can be introduced to the first pretreatment solution when the Group IIIB and/or IVB metals are in their nitrate forms. The amount of nitrate introduced in this manner, however, will typically not be sufficient to achieve the desired molar ratio of nitrate to Group IIIB/IVB metal, discussed further below. For example, the introduction of 500 ppm of zirconyl nitrate to the solution will result in a nitrate to zirconium molar ratio of about 2:1. Increasing the amount of zirconyl nitrate added to the solution would serve to increase the concentration of both the zirconium and the nitrate without changing the molar ratio of nitrate to zirconium. In order to achieve the desired molar ratio through addition of Group IIIB/IVB nitrates, the Group IIIB and/or IVB metal levels would be much higher than desired. Thus, if the Group IIIB and/or IVB metal is introduced in its nitrate form, additional nitrate should also be introduced to get the desired nitrate:Group IIIB/IVB molar ratio. It will be appreciated, therefore, that the first pretreatment solution differs from other solutions taught in the art in which a Group IIIB and/or IVB metal is introduced in its nitrate form; as illustrated above, such a composition will not provide the desired levels of both the Group IIIB and/or Group IVB metal and the nitrate.

More specifically, the compositions used in the present invention will have a large excess of nitrate as compared to the Group IIIB/IVB metal(s). A nitrate to Group IIIB/IVB molar ratio of greater than 18:1 to less than 55:1 is typically suitable. A particularly suitable molar ratio is about 29:1.

The Group IIIB and/or IVB metal and nitrate are typically in a medium, such as an aqueous medium, usually in the form of an aqueous solution or dispersion depending on the solubility of the metal compound and nitrate compound being used. The pH of the first pretreatment solution usually ranges from 2.0 to about 7.0, such as about 3.5 to 5.5. The pH of the medium may be adjusted using mineral acids such as hydrofluoric acid, fluoroboric acid, phosphoric acid, and the like, including mixtures thereof; organic acids such as lactic acid, acetic acid, citric acid, or mixtures thereof; and water soluble or water dispersible bases such as sodium hydroxide, ammonium hydroxide, ammonia, or amines such as triethylamine, methylethyl amine, diisopropanolamine, or mixtures thereof.

Different pH's may be desired for different applications. For example, a pH of about 3.5 may be desired for immersion applications, while a pH of about 3.5 to 5.5 may be desired for spray applications.

The first pretreatment solution may optionally contain other materials such as nonionic surfactants and auxiliaries conventionally used in the art of pretreatment. In an aqueous medium, water dispersible organic solvents may be present, for example, alcohols with up to about eight carbon atoms such as methanol, isopropanol, and the like, or glycol ethers such as the monoalkyl ethers of ethylene glycol, diethylene glycol, or propylene glycol, and the like. When present, water dispersible organic solvents are typically used in amounts up to about ten percent by volume, based on the total volume of aqueous medium.

Other optional materials include surfactants that function as defoamers or substrate wetting agents. Anionic, cationic, amphoteric, or nonionic surfactants may be used. Compatible mixtures of such materials are also suitable. Defoaming surfactants are typically present at levels up to about 1 percent, preferably up to about 0.1 percent by volume, and wetting agents are typically present at levels up to about 2 percent, preferably up to about 0.5 percent by volume, based on the total volume of medium.

In one embodiment, the first pretreatment solution used in the present methods is essentially free of polymeric material. "Essentially free" means less than about 0.01 weight percent (i.e. <100 ppm). This includes any kind of polymeric material or film-forming composition. Specifically excluded are, for example, polyacrylic acids, polyphenols, and polyamides. Also specifically excluded are the polymeric materials described in U.S. Pat. Nos. 3,912,548; 4,376,000; 4,457,790; 4,517,028; 4,944,812; 4,963,596; 4,970,264; 5,039,770; 5,063,089; 5,116,912; 5,129,967; 5,328,525; 5,342,456; 5,449,414; 5,449,415; 5,662,746; 5,801,217; 5,804,652; 5,859,106; 5,859,107; 5,905,105; 6,168,868; 6,217,674; 6,312,812; 6,361,622; WO95/33969; WO96/27034 and JP Tokkai 11-061432, all of which are incorporated by reference herein.

The first pretreatment solution may be applied to the metal substrate by known application techniques, such as dipping, immersion, spraying, intermittent spraying, dipping followed by spraying or spraying followed by dipping. Typically, the medium is applied to the metal substrate at a temperature ranging from ambient to 150° F. (ambient to 65° C.); use of the medium at ambient temperature gives good results. A reduction of energy requirements can therefore be realized by use of the present methods, which can be run at room temperature, as compared to other methods in which the treatment solutions must be heated to 140° F. or higher to be effective. The contact time is generally between 10 seconds and 5 minutes, such as between 30 seconds and 2 minutes when dipping the metal substrate in the medium or when the medium is sprayed onto the metal substrate.

Continuous coating processes are typically used in the coil coating industry and also for mill application. The first pretreatment solution can be applied by any of these conventional processes. For example, in the coil industry, the substrate is cleaned and rinsed and then usually contacted with the pretreatment coating composition by roll coating with a chemical coater. The treated strip is then dried by heating and painted and baked by conventional coil coating processes.

Optionally, the first pretreatment solution can be applied in a mill by immersion, spray or roll coating the freshly manufactured metal strip. Excess pretreatment composition is typically removed by wringer rolls. After the first pretreatment solution has been applied to the metal surface, the metal can be rinsed with deionized water and dried at room temperature or at elevated temperatures to remove excess moisture from the treated substrate surface and to cure any curable coating components to form the first pretreatment coating. Alternately, the treated substrate can be heated at about 65° C. to about 250° C. for about 2 seconds to about 1 minute to produce a coated substrate having a dried or cured residue of the first pretreatment thereon. If the substrate is already heated from the hot melt production process, no post application heating of the treated substrate is required to facilitate drying. The temperature and time for drying the coating will depend upon such variables as the percentage of solids in the coating, components of the coating composition and type of substrate.

Other optional steps may be included in the process of the present invention. For example, the metal surface may be rinsed with an aqueous acidic solution after cleaning with the alkaline cleaner and before contact with the first pretreatment solution. Examples of rinse solutions include mild or strong acidic cleaners such as the dilute nitric acid solutions commercially available and conventionally used in metal pretreatment processes.

The second pretreatment solution is then deposited upon at least a portion of the substrate treated with the first pretreatment solution. As noted above, the second pretreatment solution comprises a reaction product of one or more epoxy-functional materials or derivatives thereof and one or more materials selected from phosphorus-containing materials, amine-containing materials, sulfur-containing materials and mixtures thereof.

Useful epoxy-functional materials contain at least one epoxy or oxirane group in the molecule, such as monoglycidyl ethers of a monohydric phenol or alcohol or di- or polyglycidyl ethers of polyhydric alcohols. It is especially suitable if the epoxy-functional material contains at least two epoxy groups per molecule and has aromatic or cycloaliphatic functionality to improve adhesion to the metal substrate. Further, the epoxy-functional materials can be relatively more hydrophobic than hydrophilic in nature.

Examples of suitable monoglycidyl ethers of a monohydric phenol or alcohol include phenyl glycidyl ether and butyl glycidyl ether. Useful polyglycidyl ethers of polyhydric alcohols can be formed by reacting epihalohydrins with polyhydric alcohols, such as dihydric alcohols, in the presence of an alkali condensation and dehydrohalogenation catalyst such as sodium hydroxide or potassium hydroxide. Useful epihalohydrins include epibromohydrin, dichlorohydrin and epichlorohydrin. Suitable polyhydric alcohols can be aromatic, aliphatic or cycloaliphatic.

Nonlimiting examples of suitable aromatic polyhydric alcohols include phenols that are preferably at least dihydric phenols. Nonlimiting examples of aromatic polyhydric alcohols useful in the present invention include dihydroxybenzenes, for example resorcinol, pyrocatechol and hydroquinone; bis(4-hydroxphenyl)-1,1-isobutane; 4,4-dihydroxybenzophenone; bis(4-hydroxyphenol)-1,1-ethane; bis(2-hydroxyphenyl)methane; 1,5-hydroxynaphthalene; 4-isopropylidene bis(2,6-dibromophenol); 1,1,2,2-tetra(p-hydroxy phenyl)-ethane; 1,1,3-tris(p-hydroxy phenyl)-propane; novolac resins; bisphenol F; long-chain bisphenols; and 2,2-bis(4-hydroxyphenyl)propane, i.e., bisphenol A, which is especially suitable.

Nonlimiting examples of aliphatic polyhydric alcohols include glycols such as ethylene glycol, diethylene glycol, triethylene glycol, 1,2-propylene glycol, 1,4-butylene glycol, 2,3-butylene glycol, pentamethylene glycol, polyoxyalkylene glycol; polyols such as sorbitol, glycerol, 1,2,6-hexanetriol, erythritol and trimethylopropane; and mixtures thereof. An example of a suitable cycloaliphatic alcohol is cyclohexanedimethanol.

Suitable epoxy-functional materials have an epoxy equivalent weight ranging from about 100 to about 4000, and preferably about 100 to about 500, as measured by titration with perchloric acid using methyl violet as an indicator. Useful epoxy functional materials are disclosed in U.S. Pat. Nos. 5,294,265; 5,306,526 and 5,653,823, which are hereby incorporated by reference.

Examples of suitable commercially available epoxy-functional materials are EPON 828 LC (880), 1001, 1002, 1004, 1007, 1009, 826 and 828 epoxy resins, which are epoxy functional polyglycidyl ethers of bisphenol A prepared from bisphenol-A and epichlorohydrin and are commercially available from Shell Chemical Company. EPON 828 epoxy resin has a number average molecular weight of about 400 and an epoxy equivalent weight of about 185–192. EPON 826 epoxy resin has an epoxy equivalent weight of about 178–186.

Other useful epoxy-functional materials include epoxy-functional acrylic polymers, glycidyl esters of carboxylic acids and mixtures thereof.

Useful derivatives of epoxy-functional materials include the reaction products of one or more epoxy-functional materials, such as those discussed above, with one or more substituted aldehydes or ketones or mixtures thereof. Suitable hydroxy-substituted aldehydes and ketones include 4-hydroxybenzaldehyde, 3-hydroxybenzaldehyde, 2-hydroxybenzaldehyde (salicylaldehyde), vanillin, syringaldehyde, 2'-hydroxyacetophenone, 3'-hydroxyacetophenone, 4'-hydroxyacetophenone, 4'hydroxy-2'-methylacetophenone, 4'-hydroxy-4'-ethylacetophenone and 2,4-dihydroxybenzophenone. Useful amino substituted aldehydes and ketones include 2'-aminoacetophenone, 3'-aminoactophenone and 4'-aminoacetophenone. Suitable carboxy substituted aldehydes and ketones include 2-carboxybenzaldehyde, 3-carboxybenzaldehyde, 4-carboxybenzaldehyde and succinic semialdehyde.

An example of a useful derivative of an epoxy-functional material is the reaction product of a polyglycidyl ether of bisphenol A and 4-hydroxybenzaldehyde.

As discussed above, the epoxy-containing material or derivative thereof can be reacted with one or more phosphorus-containing materials to form an ester, such as an organophosphate or organophosphonate. Suitable phosphorus-containing materials include phosphinic acids, phosphonic acids, phosphoric acids, phosphites, phosphonites and mixtures thereof.

Examples of suitable phosphinic acids include those having at least one group of the structure:

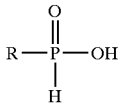

where R can be H, —C—, —$(CH_2)_n$— where n is an integer from 1 to about 18, —O—CO—$(CH_2)_2$—, or an aryl group; phenyl groups are particularly suitable. A suitable phosphinic acid is phenyl phosphinic acid (benzene phosphinic acid). Other useful phosphinic acids include glyphosate-3 and hypophosphorous acid.

Examples of suitable phosphonic acids include those having at least one group of the structure:

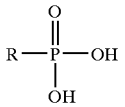

where R can be H, —C—, —$(CH_2)_n$— where n is an integer from 1 to about 18, —O—CO—$(CH_2)_2$—, or an aryl group; again, a phenyl group is particularly suitable. A suitable phosphonic acid is phenyl phosphonic acid.

Examples of other suitable phosphonic acids include phosphorous acid, 1-hydroxyethylidene-1,1-diphosphonic acid, methylene phosphonic acids, and alpha-aminomethylene phosphonic acids containing at least one group of the structure:

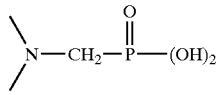

such as (2-hydroxyethyl)aminobis(methylene phosphonic) acid, isopropylaminobis(methylenephosphonic) acid and other aminomethylene phosphonic acids disclosed in U.S. Pat. No. 5,034,556 at column 2, line 52 to column 3, line 43, which is hereby incorporated by reference.

Other useful phosphonic acids include alpha-carboxymethylene phosphonic acids containing at least one group of the structure:

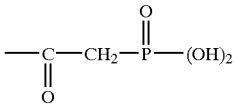

such as phosphonoacetic acid.

Other examples of useful phosphonic acids include benzylaminobis(methylene phosphonic) acid, cocoaminobis (methylene phosphonic) acid, triethylsilypropylamino (methylene phosphonic) acid and carboxyethyl phosphonic acid.

Suitable esters of phosphorus-containing materials include esters of any of the phosphinic acids, phosphonic acids or phosphoric acid discussed above, for example phosphoric acid esters of bisphenol A diglycidyl ether, benzylaminobis(methylenephosphonic) ester of bisphenol A diglycidyl ether, carboxyethyl phosphonic acid ester of bisphenol A diglycidyl ether, phenylglycidyl ether and butyl glycidyl ether; carboxyethyl phosphonic acid mixed ester of bisphenol A diglycidyl ether and butyglycidyl ether; triethoxyl silyl propylaminobis(methylenephosphonic) acid ester of bisphenol A diglycidyl ether and cocoaminobis (methylenephosphonic) acid ester of bisphenol A diglycidyl ether.

The epoxy-containing material or derivative thereof and phosphorus-containing material are typically reacted in an equivalent ratio of about 1:0.5 to about 1:10, and preferably about 1:1 to about 1:4. The epoxy-functional material or derivative and phosphorus-containing material can be reacted together by any method well known to those skilled in the art, such as a reverse phosphatization reaction in which the epoxy-containing material is added to the phosphorus-containing material.

Typically, the reaction product of the epoxy-functional material or derivative and phosphorus-containing material has a number average molecular weight of up to about 10,000, such as about 500 to about 1000, as measured by gel permeation chromatography using polystyrene as a standard.

In one embodiment, the pretreatment coating comprises one or more esters of a phosphorus-containing material, such as those discussed above. Other suitable esters include the reaction product of phosphorus pentoxide as $P_4O_{10}$ and an alcohol in a 1:6 molar ratio of oxide to alcohol to produce a mixture of mono- and diphosphate esters, such as is disclosed in the 18 *Encyclopedia of Chemical Technology*, ($4^{th}$ Ed. 1996) at page 772, which is hereby incorporated by reference. Examples of suitable alcohols include aliphatic alcohols such as ethylene glycol, phenols such as bisphenol A, and cycloaliphatic alcohols.

In another embodiment, which gives particularly good results, the reaction product is formed from one or more epoxy-containing materials or derivatives as discussed above, and one or more amine-containing materials selected from primary amines, secondary amines, tertiary amines and mixtures thereof. Examples of suitable primary amines include n-bufyl amine and fatty amines such as ARMEEN 18D, which is commercially available from Akzo Nobel. Suitable secondary amines include diisopropanolamine, diethanolamine and di-butyl amine. An example of a useful tertiary amine is ARMEEN DM18D dimethyl C18 tertiary amine.

The amine-containing material can comprise at least one alkanolamine or a mixture of different alkanolamines. Primary or secondary alkanolamines are preferred, but tertiary alkanolamines can also be used. Especially suitable alkanolamines include alkanol groups containing less than about 20 carbon atoms and more preferably less than about 10 carbon atoms. Nonlimiting examples of suitable alkanolamines include methylethanolamine, ethylethanolamine, diethanolamine, methylisopropanolamine, monoethanolamine and diisopropanolamine. Especially suitable tertiary alkanolamines contain two methyl groups, such as dimethylethanolamine.

The epoxy-functional material or derivative and amine-containing material are preferably reacted in an equivalent ratio ranging from about 5:1 to about 0.25:1, such as about 2:1 to about 0.5:1. The epoxy-functional material or derivative and amine-containing material can be reacted together by any method known to those skilled in the art of polymer synthesis, such as solution or bulk polymerization techniques. For example, an alkanolamine can be added to an epoxy-functional material and diluent, mixed at a controlled rate and the mixture heated at a controlled temperature under a nitrogen blanket or other procedure for reducing the presence of oxygen during the reaction. Suitable diluents for reducing the viscosity of the mixture during the reaction include alcohols containing up to about 8 carbon atoms, such as ethanol or isopropanol, and glycol ethers such as the monoalkyl ethers of ethylene glycol, diethylene glycol or propylene glycol.

If a tertiary alkanolamine is used, a quaternary ammonium compound is formed. Typically, this reaction is carried out by adding all of the raw materials to the reaction vessel at the same time and heating the mixture, usually with a diluent, at a controlled temperature. Usually, an acid such as a carboxylic acid is present to ensure that the quatemary ammonium salt is formed rather than a quatermary ammonium hydroxide. Suitable carboxylic acids include lactic acid, citric acid, adipic acid and acetic acid. Quaternary ammonium salts are useful because they are more easily dispensed in water and can be used to form an aqueous dispersion having a pH near the desired application range.

Generally, the reaction product of the epoxy-functional material or derivative and amine-containing material has a number average molecular weight of up to about 10,000, and preferably about 500 to about 750, as measured by gel permeation chromatography using polystyrene as a standard.

In another embodiment, the reaction product can be formed from one or more epoxy-containing materials or derivatives such as discussed above and one or more sulfur-containing materials, such as aliphatic or aromatic mercaptans, sulfonates, sulfones, sulfoniums, sulfides, sulfoxides and mixtures thereof.

A treating solution of one or more of any of the reaction products discussed above can be prepared by mixing the reaction product(s) with a diluent, such as water, at a temperature of about 10° C. to about 70° C., such as about 15° C. to about 25° C. Preferably, the reaction product is soluble or dispersible in water diluent to the extent of at least about 0.03 grams per 100 grams of water at a temperature of about 25° C. The reaction product generally comprises about 0.05 to about 10 weight percent of the treating solution on a total weight basis.

Useful diluents include water or mixtures of water and cosolvents. Suitable cosolvents include alcohols having up to about 8 carbon atoms, such as ethanol and isopropanol, and alkyl ethers of glycols, such as 1-methoxy-2-propanol, monoalkyl ethers of ethylene glycol diethylene glycol and propylene glycol and dialkyl ethers of ethylene glycol or ethylene glycol formal. In a particularly suitable embodiment, the diluent includes a propylene glycol monomethyl ether such as DOWANOL PM, or a dipropylene glycol monomethyl ether such as DOWANOL DPM, both of which are commercially available from Dow Chemical Company, or MAZON 1651 butyl carbitol formal, which is commercially available from BASF Corp. Other useful diluents include bases such as amines that can partially or completely neutralize the organophosphate or organophosphonate to enhance the solubility of the compound. Non-limiting examples of suitable amines include ammonia, primary amines, secondary amines, such as diisopropanolamine, and tertiary amines such as triethylamine, dimethylethanolamine and 2-amino-2-methyl-1-propanol. Non-aqueous diluents are typically present in amounts ranging from about 0.1 to about 5 weight percent on a basis of total weight of the treating solution. Water can be present in amounts ranging from about 50 to about 99 weight percent on a basis of total weight of the treating solution.

Typically, water-soluble or water-dispersible acids and/or bases are used to adjust the pH of the second pretreatment solution to about 2 to about 9, and preferably about 3 to about 5. Suitable acids include mineral acids, such as hydrofluoric acid, fluorozirconic acid, fluoroboric acid, phosphoric acid, sulfamic acid and nitric acid; organic acids, such as lactic acid, acetic acid, hydroxyacetic acid, citric acid, and mixtures thereof. Suitable bases include inorganic bases, such as sodium hydroxide and potassium hydroxide; nitrogen-containing compounds such as ammonia, triethylamine, methanolamine, diisopropanolamine; and mixtures thereof.

Optionally, the second pretreatment solution further comprises a fluorine-containing material as a source of fluoride ions. Suitable fluorine-containing materials include hydrofluoric acid, fluorozirconic acid, fluorosilicic acid, fluoroboric acid, sodium hydrogen fluoride, potassium hydrogen fluoride, ammonium hydrogen fluoride and mixtures thereof. Preferably, the concentration of fluorine-containing material if used in the second pretreatment coating ranges from about 100 to about 5200 ppm such as about 300 to about 3500 ppm. Generally, the weight ratio of reaction product to fluoride ions ranges from about 1:1 to about 55:1.

The fluorine-containing material can be applied to the metal substrate prior to application of the second pretreatment solution or included in the second pretreatment solution itself. If applied prior to application of the treating solution, the pH of an aqueous solution including the fluorine-containing material should generally range from about 2.4 to about 4.0 and can be adjusted by adding sodium hydroxide.

Optionally, the second pretreatment solution can further comprise one or more Group IIIB and/or IVB metals, such as those discussed above. Generally, such a metal-containing material, if used, is included in the second pretreatment solution in an amount to provide a concentration of up to about 10,000 ppm, such as about 50 to about 2000 ppm, based upon total weight of the treating solution.

The second pretreatment solution can further comprise surfactants that function as aids to improve wetting of the substrate. Generally, the surfactant materials are present in an amount of less than about 2 weight percent on the basis of total weight of the treating solution.

In one embodiment, the pretreatment solutions are essentially free of chromium-containing materials, i.e., they contain less than about 2 weight percent of chromium-containing materials (expressed as $CrO_3$), such as less than about 0.05 weight percent of chromium-containing materials. Examples of such chromium-containing materials include chromic acid, chromium trioxide, chromic acid anhydride, and chromate and dichromate salts of ammonium, sodium, potassium, calcium, barium, zinc and strontium. Most preferably, the treating solutions are free of chromium-containing materials.

In a particularly suitable embodiment, the reaction product of an epoxy-functional material and a phosphorus-containing material is formed from EPON 880 (828 LC) epoxy-functional resin and phenylphosphonic acid in an equivalent ratio of about 1:1 to about 1:2. The reaction product is present in the second pretreatment solution in an amount of about 0.1 weight percent on a basis of total weight of the treating solution. This solution also includes diisopropanolamine, solvent and deionized water.

In another particularly suitable embodiment, the reaction product of an epoxy functional material and phosphorus-containing material is formed from the reaction product of (a) EPON 880 (828 LC ) epoxy-functional resin and 4-hydroxybenzaldehyde in an equivalent ratio of about 1:1 and (b) phenylphosphinic acid in an equivalent ratio of about 1:1. The reaction product is present in the second pretreatment solution in an amount of about 0.1 weight percent on the basis of total weight of the second pretreatment solution. A particularly suitable second pretreatment solution also includes diisopropanolamine, solvent and deionized water.

In an alternative embodiment, the components of the first and second pretreatment solutions are combined in a single pretreatment composition.

The second pretreatment solution can be applied to the surface of the metal substrate by any conventional application technique, such as spraying, immersion or roll coating in a batch or continuous process. The temperature of the treating solution at application is typically about 10° C. to about 85° C., such as about 15° C. to about 40° C. The pH of the second treating solution at application generally ranges from about 2.0 to about 9.0, such as about 3 to about 5.

The film coverage of the residue of the entire pretreatment coating generally ranges from about 0.1 to about 1000 milligrams per square meter ($mg/m^2$), such as about 1 to about 400 $mg/m^2$.

Optionally, a weldable coating can be deposited upon at least a portion of the pretreatment coating formed from the first and second pretreatment solutions. The weldable coating is formed from a weldable composition comprising one or more electroconductive pigments, which provide electroconductivity to the weldable coating, and one or more binders, which adhere the electroconductive pigment to the pretreatment coating. The overall thickness of the pretreatment coating over which the weldable coating is applied can vary, but is generally less than about 1 micrometer, such as from about 1 to about 500 nanometers or about 10 to about 300 nanometers. Suitable weldable coatings and methods for their application are further described in U.S. Pat. No. 6,312,812 B1, columns 13 to 15, incorporated by reference herein.

It is an advantage of the present invention that after contact with the second pretreatment solution, the substrate may be rinsed with water and coated directly; i.e., without a phosphating step as is conventional in the art. Coating may be done immediately or after a drying period at ambient or elevated temperature conditions and can be done by any means known in the art.

The substrate that has been contacted with the two pretreatment solutions described above is then coated with a composition comprising a film-forming resin. Any resin that forms a film can be used according to the present methods, absent compatibility problems. For example, resins suitable for either electrocoat, powder or liquid coating compositions can be used. A particularly suitable resin is one formed from the reaction of a polymer having at least one type of reactive functional group and a curing agent having functional groups reactive with the functional group of the polymer. The polymers can be, for example, acrylic, polyester, polyether or polyurethane, and can contain functional groups such as hydroxyl, carboxylic acid, carbamate, isocyanate, epoxy, amide and carboxylate functional groups.

The use in powder coatings of acrylic, polyester, polyether and polyurethane polymers having hydroxyl functionality is well known. Monomers for the synthesis of such polymers are typically chosen so that the resulting polymers have a Tg greater than 50° C. Examples of such polymers are described in U.S. Pat. No. 5,646,228 at column 5, line 1 to column 8, line 7, incorporated herein by reference.

Acrylic polymers and polyester polymers having carboxylic acid functionality are also suitable for powder coatings. Monomers for the synthesis of acrylic polymers having carboxylic acid functionality are typically chosen such that the resulting acrylic polymer has a Tg greater than 40° C., and for the synthesis of the polyester polymers having carboxylic acid functionality such that the resulting polyester polymer has a Tg greater than 50° C. Examples of carboxylic acid group-containing acrylic polymers are described in U.S. Pat. No. 5,214,101 at column 2, line 59 to column 3, line 23, incorporated herein by reference. Examples of carboxylic acid group-containing polyester polymers are described in U.S. Pat. No. 4,801,680 at column 5, lines 38 to 65, incorporated herein by reference.

The carboxylic acid group-containing acrylic polymers can further contain a second carboxylic acid group-containing material selected from the class of $C_4$ to $C_{20}$ aliphatic dicarboxylic acids, polymeric polyanhydrides, low molecular weight polyesters having an acid equivalent weight from about 150 to about 750, and mixtures thereof. This material is crystalline and can be a low molecular weight crystalline carboxylic acid group-containing polyester.

Also useful in the present powder coating compositions are acrylic, polyester and polyurethane polymers containing carbamate functional groups. Examples are described in WO Publication No. 94110213, incorporated herein by reference. Monomers for the synthesis of such polymers are typically chosen so that the resulting polymer has a Tg greater than about 40° C.

Many of the polymers described above require the use of curing agents. Suitable curing agents generally include blocked isocyanates, polyepoxides, polyacids, polyols, anhydrides, polyamines, aminoplasts and phenoplasts. The appropriate curing agent can be selected by one skilled in the art depending on the polymer used. For example, blocked isocyanates are suitable curing agents for hydroxy and primary and/or secondary amino group-containing materials. Examples of blocked isocyanates are those described in U.S. Pat. No. 4,988,793, column 3, lines 1 to 36, incorporated herein by reference. Polyepoxides suitable for use as curing agents for COOH functional group-containing materials are described in U.S. Pat. No. 4,681,811 at column 5, lines 33 to 58, incorporated herein by reference. Polyacids as curing agents for epoxy functional group-containing materials are described in U.S. Pat. No. 4,681,811 at column 6, line 45 to column 9, line 54, incorporated herein by reference. Polyols, materials having an average of two or more hydroxyl groups per molecule, can be used as curing agents for NCO functional group-containing materials and anhydrides, and are well known in the art. Polyols for use in the present invention are typically selected such that the resultant material has a Tg greater than about 50° C.

Anhydrides as curing agents for epoxy functional group-containing materials include, for example, trimellitic anhydride, benzophenone tetracarboxylic dianhydride, pyromellific dianhydride, tetrahydrophthalic anhydride, and the like as described in U.S. Pat. No. 5,472,649 at column 4, lines 49 to 52, incorporated herein by reference. Aminoplasts as curing agents for hydroxy, COOH and carbamate functional group-containing materials are well known in the art. Examples of such curing agents include aldehyde condensates of glycoluril, which give high melting crystalline products useful in powder coatings. While the aldehyde used is typically formaldehyde, other aldehydes such as acetaldehyde, crotonaldehyde, and benzaldehyde can be used.

Hybrid resin systems, in which coreactive resins are used without a curing agent, can also be used. An example is an epoxylpolyether hybrid system.

The present methods can also employ film-forming resins that are liquid, that is, water-borne or solvent-borne systems. Such solvents include, for example, alcohols, ketones, aromatic hydrocarbons, glycol ethers, esters or mixtures thereof. Examples of polymers useful in forming the resin in the liquid coatings of the present invention include hydroxyl or carboxylic acid-containing acrylic copolymers, hydroxyl or carboxylic acid-containing polyester polymers, oligomers and isocyanate or hydroxyl-containing polyurethane polymers, and amine or isocyanate-containing polyureas. These polymers are further described in U.S. Pat. No. 5,939,491, column 7, line 7 to column 8, line 2; this patent, as well as the patents referenced therein, are incorporated by reference herein. Curing agents for these resins are also described in the '491 patent at column 6, lines 6 to 62. In solvent-based compositions, the solvent is generally present in amounts ranging from 5 to 80 weight percent based on total weight of the composition, such as 30 to 50 percent. These weight percents can be even higher for water based coatings.

The powder coating compositions of the present invention may optionally contain additional additives such as waxes for flow and wetting, flow control agents, such as poly(2-ethylhexyl)acrylate, degassing additives such as benzoin and MicroWax C, adjuvant resin to modify and optimize coating properties, antioxidants, ultraviolet (UV) light absorbers and catalysts. Examples of useful antioxidants and UV light absorbers include those available commercially from Ciba-Geigy under the trademarks IRGANOX and TINUVIN. These optional additives, when used, are typically present in amounts up to 20 percent by weight, based on total weight of the coating.

The liquid coating compositions of the present invention can similarly contain optimal additives such as plasticizers, antioxidants, light stabilizers, UV absorbers, thixotropic agents, anti-gassing agents, organic cosolvents, biocides, surfactants, flow control additives and catalysts. Any such additives known in the art can be used, absent compatibility problems.

The powder coating compositions are most often applied by spraying, and in the case of a metal substrate, by electrostatic spraying, or by the use of a fluidized bed. The powder coating can be applied in a single sweep or in several passes to provide a film having a thickness after cure of from about 1 to 10 mils (25 to 250 micrometers), usually about 2 to 4 mils (50 to 100 micrometers). Other standard methods for coating application can be employed such as brushing, dipping or flowing.

The liquid compositions of the invention can also be applied by any conventional method such as brushing, draw down, dipping, flow coating, roll coating, conventional and electrostatic spraying. Spray techniques are most often used. Typically, film thickness for liquid coatings can range between 0.1 and 5 mils, such as between 0.1 and 1 mil, or about 0.4 mils.

Generally, after application of the coating composition, the coated substrate is baked at a temperature sufficient to cure the coating. Metallic substrates with powder coatings are typically cured at a temperature ranging from 250° F. to 500° F. (121.1° C. to 260.0° C.) for 1 to 60 minutes, or from 300° F. to 400° F. (148.9° C. to 204.4° C.) for 15 to 30 minutes.

Several liquid formulations can be cured at ambient temperature, such as those using a polyisocyanate or polyanhydride curing agent, or they can be cured at elevated temperatures to hasten the cure. An example would be forced air curing in a down draft booth at about 40° C. to 60° C., which is common in the automotive refinish industry. The ambient temperature curable compositions are usually prepared as a two (2) package system in which the curing agent is kept separate from the polysiloxane containing the reactive functional group. The packages are combined shortly before application.

The thermally curable liquid compositions such as those using blocked isocyanate, aminoplast, phenoplast, polyepoxide or polyacid curing agent can be prepared as a one-package system. These compositions are cured at elevated temperatures, typically for 1 to 30 minutes at about 250° F. to about 450° F. (121° C. to 232° C.) with temperature primarily dependent upon the type of substrate used. Dwell time (i.e., time that the coated substrate is exposed to elevated temperature for curing) is dependent upon the cure temperatures used as well as wet film thickness of the applied coating composition.

Alternatively, the treated substrate can be coated by electrocoating. The electrocoating step is done with a substantially lead-free, curable, electrodepositable composition and is followed by a curing step.

In the process of electrodeposition, the metal substrate being treated, serving as an electrode, and an electrically conductive counter electrode are placed in contact with an ionic, electrodepositable composition. Upon passage of an electric current between the electrode and counter electrode while they are in contact with the electrodepositable composition, an adherent film of the electrodepositable composition will deposit in a substantially continuous manner on the metal substrate.

The electrodeposition is usually carried out at a constant voltage in the range of from about 1 volt to several thousand volts, typically between 50 and 500 volts. Current density is usually between about 1.0 ampere and 15 amperes per square foot (10.8 to 161.5 amperes per square meter) and tends to decrease quickly during the electrodeposition process, including formation of a continuous self-insulating film.

After electrodeposition, the coating is heated to cure the deposited composition. The heating or curing operation is usually carried out at a temperature in the range of from 120° C. to 250° C., preferably from 120° C. to 190° C. for a period of time ranging from 10 to 60 minutes. The thickness of the resultant film is usually from about 10 to 50 microns.

Preferably in the electrocoating step, the metal substrate being treated serves as a cathode, and the electrodepositable composition is cationic.

In one embodiment of the invention, the substantially lead-free, curable cationic electrodepositable composition contains an amine salt group-containing resin derived from a polyepoxide. The resin is used in combination with a polyisocyanate curing agent that is at least partially capped with a capping agent.

In a particularly suitable embodiment, the cationic resin is derived from a polyepoxide, which may be chain extended by reacting together a polyepoxide and a polyhydroxyl group-containing material selected from alcoholic hydroxyl group-containing materials and phenolic hydroxyl group-containing materials to chain extend or build the molecular weight of the polyepoxide. The resin contains cationic salt groups and active hydrogen groups selected from aliphatic hydroxyl and primary and secondary amino. Suitable electrocoat compositions are further described in U.S. Pat. No. 6,168,868 B1, columns 4 to 9, incorporated by reference herein.

Untreated metal substrates coated by the methods of the present invention demonstrate excellent corrosion resistance as determined by salt spray corrosion resistance testing. The excellent corrosion resistance is achieved even with the elimination of the phosphating step. Accordingly, the present invention is also directed to a metal substrate coated by any of the methods described herein.

As used herein, unless otherwise specified, all numbers such as those expressing values, ranges, amounts or percentages may be read as if prefaced by the word "about", even if the term does not expressly appear. Any numerical range recited herein is intended to include all sub-ranges subsumed therein. Also, as used herein, the term "polymer" is meant to refer to oligomers and both homopolymers and copolymers; the prefix "poly" refers to two or more.

EXAMPLES

The following examples are intended to illustrate the invention, and should not be construed as limiting the invention in any way.

Example 1

Untreated cold rolled steel ("CRS"), two-sided electrogalvanized ("EG") (EZG-60G) steel, and aluminum ("Al") (Al 6016-T6) test panels were purchased from ACT Laboratories of Hillsdale, Mich. Each panel was about 10.16 centimeters ("cm") wide, about 15.24 cm long and about 0.76 to 0.79 millimeters ("mm") thick. The test panels were treated according to the seven stages described in Table 1 unless otherwise noted and as further indicated below.

TABLE 1

| Stage | Process | Description |
|---|---|---|
| 1 | Clean | CHEMKLEEN 611L[1] (2% by volume) sprayed at 140° F. for 1 minute |
| 2 | Rinse | Tap water, 15–60 second immersion, ambient temperature |
| 3 | Treat | Acid treatment stage (comprising fluorozirconic acid[2]), sprayed at ambient temperature for 60 seconds |
| 4 | Rinse | Deionized water, 15–60 second immersion, ambient temperature |
| 5 | Resin | CHEMSEAL 100[3] sprayed at ambient temperature for 60 seconds |
| 6 | Rinse | Deionized water, 15–60 second immersion, ambient temperature |
| 7 | Dry | Infrared dry-off, 30–60 seconds |

[1]Alkaline-based cleaner commercially available from PPG Industries, Inc., Pittsburgh, Pennsylvania.
[2]Available as a 45% solution from Alfa Aesar, Ward Hill, Massachusetts.
[3]Pretreatment product commercially available from PPG Industries, Inc.

As used herein, "ambient temperature" means air temperature of about 20° C. to 26° C. The pretreatment compositions used in Stage 3 of the above process were adjusted to a pH of 4.5 with 10 percent ammonium hydroxide, as measured at ambient temperature using an Accumet Research Model AR15 pH meter, commercially available from Fisher Scientific. Nitrate was added to the composition of Stage 3 for some of the testing. The concentration of Zr was 500 ppm and of $NO_3$, when used, was 10,000 ppm. The solution was sprayed onto the panels in a standard pretreatment tunnel washer.

Metal panels coated using the procedure described in Table 1 were evaluated for corrosion resistance. Tested panels include panels where the Stage 3 treatment was done both with (w/) and without (w/o) $NaNO_3$. For comparative purposes, panels painted with different types of paints, such as electrocoat, liquid topcoat, and powder topcoat were tested.

The panels were painted with SPECTRACRON SPE (a white polyester-based solventbome topcoat), POWERCRON 8000 (a black electrocoat), or ENVIROCRON PCF20128 (a tan powder paint). All three paints are commercially available from PPG Industries, Inc. Panels were cured per paint specifications with prescribed dry-film thickness. The corrosion resistance of the panels was evaluated using salt spray per ASTM B117. For SPECTRACRON SPE, the salt spray test duration was 144 hours, for POWERCRON 8000, 1000 hours, and for ENVIROCRON PCF20128, 1000 hours. At the completion of the test, panels were either taped off or sand blasted to remove corrosion products and delaminated paint. Test panels were run in quadruplets. The total paint loss from creepage front to creepage front values in Table 2 below are reported as the average of the loss measured at 6 points along the scribe of all four panels.

TABLE 2

| | Total Paint Loss (mm) | | |
|---|---|---|---|
| TREATMENT APPLIED | CRS | EG | AI |
| SPECTRACRON SPE w/o NO3 addition | 10.2 | 0 | 0.3 |
| SPECTRACRON SPE w/ NO3 addition | 2.6 | 0 | 0.1 |
| POWERCRON 8000 w/o NO3 addition | 21.6 | 5.3 | 0 |
| POWERCRON 8000 w/ NO3 addition | 13.5 | 10.3 | 0 |
| ENVIROCRON PCF20128 w/o NO3 addition | 8.8 | 2.4 | 0 |

TABLE 2-continued

| | Total Paint Loss (mm) | | |
|---|---|---|---|
| TREATMENT APPLIED | CRS | EG | AI |
| ENVIROCRON PCF20128 w/ NO3 addition | 5.8 | 3.1 | 0 |

The data in Table 2 demonstrates that the claimed process, a pretreatment of fluorozirconic acid with nitrate additives offers better corrosion results on CRS under a variety of coatings as compared with the same pretreatment lacking the nitrate additive. Relatively comparable results with and without nitrate were seen with the EG and Al substrates. The effectiveness of this pretreatment on a variety of substrates, particularly on cold rolled steel, an inherently difficult substrate on which to inhibit corrosion, is highly desirable.

Example 2

CRS panels were treated as described in Example 1, except that for Stage 7 dry off was accomplished with a heat gun instead of infrared. The treated panels were coated with SPECTRACON SPE. Creepage was determined in the same manner as Example 1.

TABLE 3

| [Zr] ppm | [NO3] ppm | pH ppm | Total Creepage (mm) |
|---|---|---|---|
| 250 | 5000 | 3.4 | 11.2 |
| 250 | 15000 | 3.4 | 16.4 |
| 250 | 5000 | 5.4 | 12.1 |
| 250 | 15000 | 5.4 | 12.1 |
| 750 | 5000 | 3.4 | 16.6 |
| 750 | 15000 | 3.4 | 10.7 |
| 750 | 5000 | 5.4 | 14.1 |
| 750 | 15000 | 5.4 | 8.0 |

TABLE 4

| [Zr] ppm | [NO3] ppm | pH ppm | Total Creepage (mm) |
|---|---|---|---|
| 250 | 5000 | 3.4 | 15.7 |
| 250 | 15000 | 3.4 | 20.8 |
| 250 | 5000 | 5.4 | 11.2 |
| 250 | 15000 | 5.4 | 16.1 |
| 750 | 5000 | 3.4 | 13.2 |
| 750 | 15000 | 3.4 | 9.3 |
| 750 | 5000 | 5.4 | 13.3 |
| 750 | 15000 | 5.4 | 10.6 |

TABLE 5

| (Stage 5 omitted in Pretreatment) | | | |
|---|---|---|---|
| [Zr] ppm | [NO3] ppm | PH ppm | Total Creepage (mm) |
| 250 | 5000 | 3.4 | 19.0 |
| 250 | 15000 | 3.4 | 21.1 |
| 250 | 5000 | 5.4 | 16.7 |
| 250 | 15000 | 5.4 | 19.4 |
| 750 | 5000 | 3.4 | 20.8 |
| 750 | 15000 | 3.4 | 16.1 |
| 750 | 5000 | 5.4 | 18.8 |
| 750 | 15000 | 5.4 | 17.1 |

This example demonstrates that a $NO_3$ to Zr molar ratio of about 29:1 generally gives better results overall than ratios of about 10:1 (750 ppm Zr to 5000 ppm $NO_3$) or about 88:1. Through these and other experiments, it has been determined that an $NO_3$:Group IIIB/IVB molar ratio of greater than 18 to less than 55:1 provides the results desired according to the present invention.

Whereas particular embodiments of this invention have been described above for purposes of illustration, it will be evident to those skilled in the art that numerous variations of the details of the present invention may be made without departing from the invention as defined in the appended claims.

Therefore, we claim:

1. A method for coating an untreated metal substrate comprising:

a) contacting the substrate with a first pretreatment solution comprising a Group IIIB and/or IVB metal and a nitrate, wherein the molar ratio of nitrate to Group IIIB and/or IVB metal is from greater than 18:1 to less than 55:1;

b) contacting the substrate of step a) with a second pretreatment solution comprising a reaction product of at least one epoxy-functional material or derivative thereof and at least one material selected from the group consisting of phosphorus-containing materials, amine-containing materials, sulfur-containing materials and mixtures thereof; and c) coating the substrate of step b) with a composition comprising a film-forming resin.

2. The method of claim 1 further comprising the step of cleaning the metal surface with an alkaline cleaner before contacting with the first pretreatment solution.

3. The method of claim 2 further comprising the step of rinsing the metal surface with an aqueous acidic solution after cleaning with the alkaline cleaner and before contacting with the first pretreatment solution.

4. The method of claim 1, wherein the Group IIIB and/or IVB metal-containing compound is a zirconium compound.

5. The method of claim 4, wherein the zirconium compound is hexafluorozirconic acid.

6. The method of claim 1, wherein the metal substrate is cold rolled steel.

7. The method of claim 1, wherein the nitrate is introduced at least in part by adding sodium nitrate to the first pretreatment solution.

8. The method of claim 1, wherein the molar ratio of nitrate to Group IIIB/IVB metal is about 29:1.

9. The method of claim 1, wherein the composition comprising a film-forming resin is a powder.

10. The method of claim 1, wherein the composition comprising a film-forming resin is a liquid.

11. The method of claim 10, wherein the liquid film-forming resin is deposited by electrodeposition.

12. A substrate coated by the process of claim 1.

* * * * *